US007438566B2

(12) United States Patent
Chen

(10) Patent No.: US 7,438,566 B2
(45) Date of Patent: Oct. 21, 2008

(54) ELECTRIC DISTRIBUTING SYSTEM

(76) Inventor: Chi-Wen Chen, No. 105, Alley 27, Lane 143, Chun-King Road, Taipei City (TW)

( * ) Notice: Subject to any disclaimer, the term of this patent is extended or adjusted under 35 U.S.C. 154(b) by 0 days.

(21) Appl. No.: 11/675,531

(22) Filed: Feb. 15, 2007

(65) Prior Publication Data

US 2008/0081500 A1 Apr. 3, 2008

(30) Foreign Application Priority Data

Sep. 29, 2006 (CN) ..... 2006 2 0136923 U

(51) Int. Cl.
*H01R 25/00* (2006.01)

(52) U.S. Cl. ..... 439/110; 439/115; 439/119; 439/121; 439/210

(58) Field of Classification Search ..... 439/110, 439/115, 119–121, 207, 210, 213, 215–216
See application file for complete search history.

(56) References Cited

U.S. PATENT DOCUMENTS 5,418,328 A * 5/1995 Nadeau ..... 174/494
5,519,175 A 5/1996 Cole
RE36,030 E 1/1999 Nadeau
6,530,791 B1 * 3/2003 Hierzer ..... 439/115

FOREIGN PATENT DOCUMENTS

DE 9111530 U1 2/1993
DE 19641090 A1 4/1997
WO 01/91248 A 11/2001
WO 02/080325 A 10/2002

* cited by examiner

*Primary Examiner*—Renee S Luebke
*Assistant Examiner*—Vanessa Girardi
(74) *Attorney, Agent, or Firm*—Schwabe, Williamson & Wyatt, P.C.

(57) ABSTRACT

An electric distributing system includes at least two electrical tracks and an electrical connector. Each electrical track includes a track body having two opposite ends, at least one of which is provided with a retaining hole, and at least two track wires disposed in the track body. The electrical connector includes a housing having at least two connecting end portions that interconnect the electrical tracks, and at least two conductive wire units disposed in the housing and connected electrically and respectively to the track wires. At least one of the connecting end portions has an engaging member projecting therefrom and engaged to the retaining hole.

8 Claims, 17 Drawing Sheets

ELECTRIC DISTRIBUTING SYSTEM

CROSS-REFERENCE TO RELATED APPLICATION

This is a United States nonprovisional application based upon Chinese Patent Application Number 200620136923.0, filed Sep. 29, 2006, and claims priority to said 200620136923.0 Application.

BACKGROUND OF THE INVENTION

1. Field of the Invention

The invention relates to an electric distributing system, more particularly to an electric distributing system including a plurality of electrical tracks and at least one electrical connector interconnecting the electrical tracks.

2. Description of the Related Art

Referring to FIGS. 1 and 2, a conventional electric distributing system 1, as disclosed in U.S. Pat. No. Re. 36,030, includes a plurality of electrical tracks 11, a plurality of electrical connectors 12 to interconnect the electrical tracks 11, a plurality of electrical receptacles 13 connected movably to the electrical tracks 11, and a power supply plug 14 connected electrically to one of the electrical tracks 11 and inserted into a socket of a fixed electrical receptacle 10. Each electrical track 11 has a rectangular track body 111, two parallel track wires 112 extending along the length of the track body 111, and a track ground wire 113 disposed between and parallel to the track wires 112. Each electrical connector 12 includes a housing 121 having at least two connecting ends 125 connected respectively to two electrical tracks 11, two terminals 123 disposed in each of the connecting ends 125 and connected electrically and respectively to the track wires 112 of one of the electrical tracks 11, and a ground terminal 124 disposed in each of the connecting ends 125 and connected electrically to the track ground wire 113 of the corresponding electrical track 11.

Although the aforementioned conventional electric distributing system 1 can achieve its intended purpose, since each electrical track 11 is only fitted in a slot in the electrical connector 12 without the use of any type of retaining mechanism, an improvement is needed to enhance connection between the electrical connectors 12 and the electrical tracks 11.

SUMMARY OF THE INVENTION

Therefore, the object of the present invention is to provide an electric distributing system that has components which can be stably and securely connected.

According to this invention, an electric distributing system comprises at least two electrical tracks and an electrical connector. Each of the electrical tracks includes a track body, and at least two track wires disposed therein. The track body has two opposite ends, at least one of which is provided with a retaining hole. The electrical connector includes a housing having at least two connecting end portions that interconnect the electrical tracks, and at least two conductive wire units disposed in the housing and connected electrically and respectively to the track wires. At least one of the connecting end portions has an engaging member projecting therefrom and engaged to the retaining hole.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
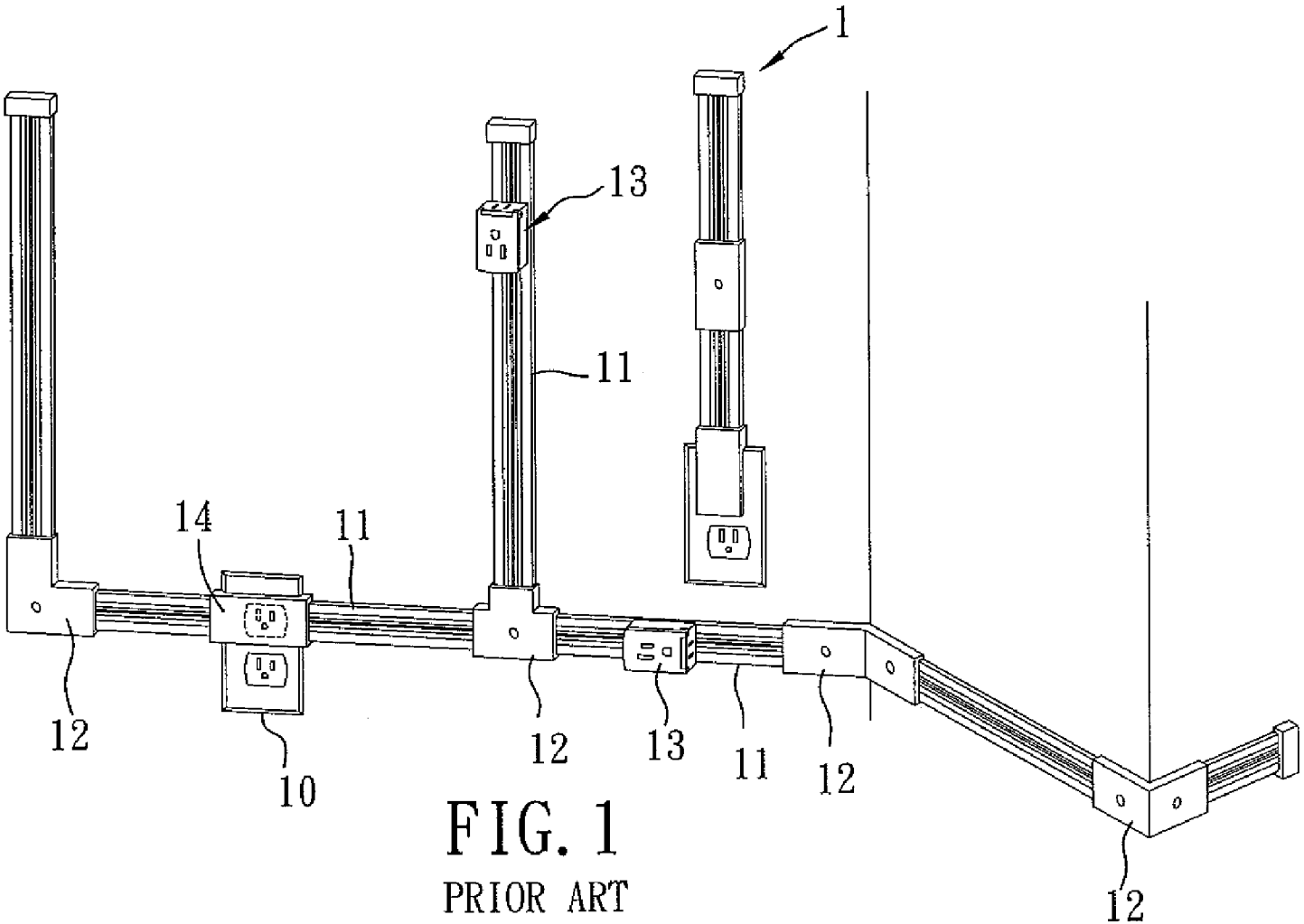
FIG. 1 PRIOR ART
FIG. 1 is a perspective view of a conventional electric distributing system disclosed in U.S. Pat. No. Re. 36,030.
Figure 2:
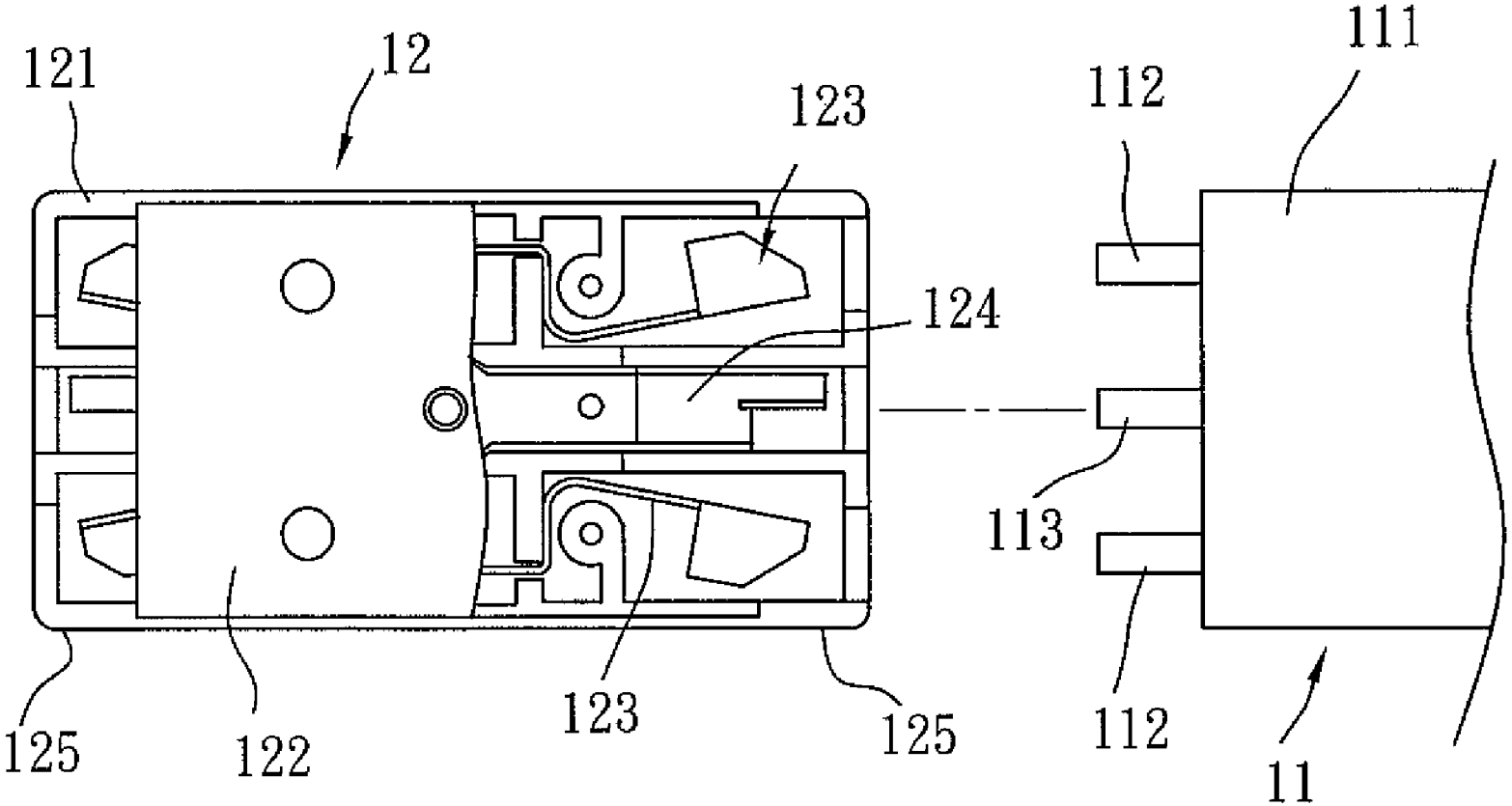
FIG. 2 PRIOR ART
FIG. 2 is an enlarged partly cutaway schematic view of an electrical track and an electrical connector of the conventional electric distributing system.
Figure 3:
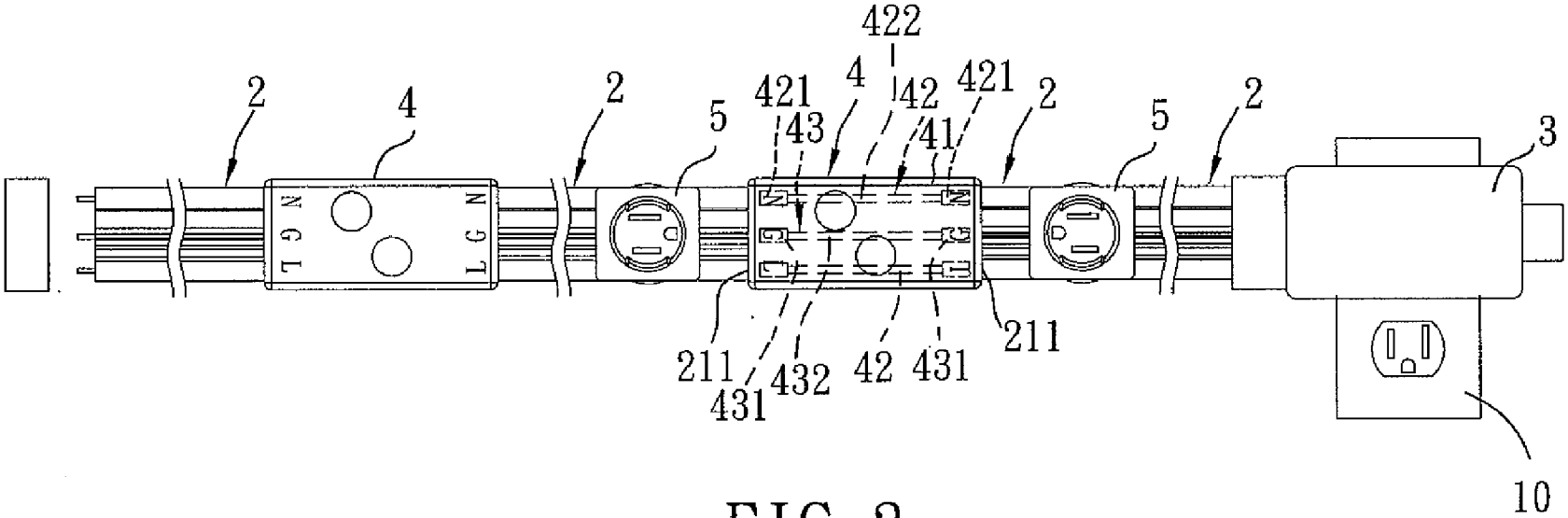
FIG. 3 is a fragmentary schematic view of the first preferred embodiment of an electric distributing system according to the present invention.
Figure 4:
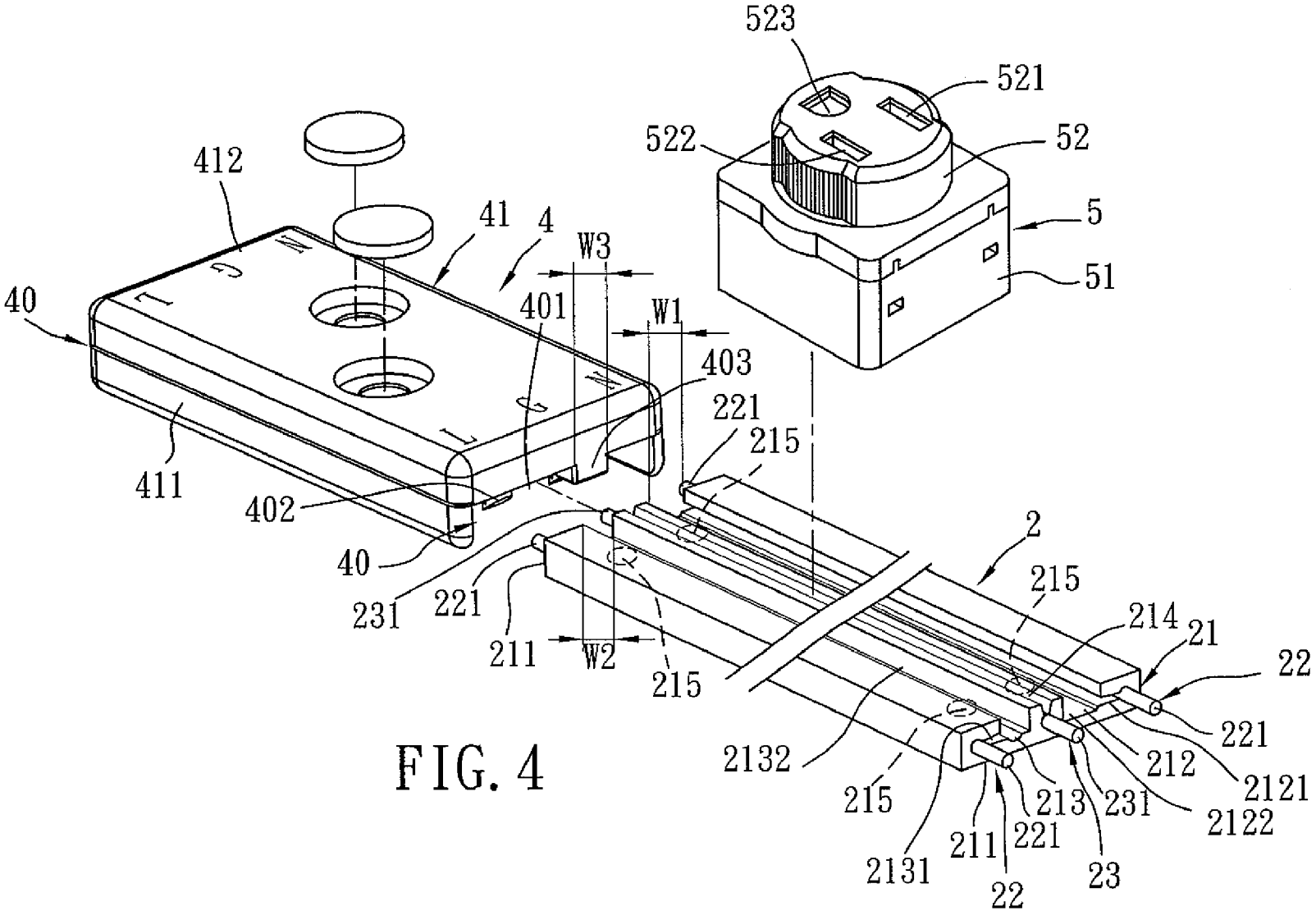
FIG. 4 is a perspective view of an electrical track, an electrical connector, and an electrical receptacle of the first preferred embodiment.
Figure 5:
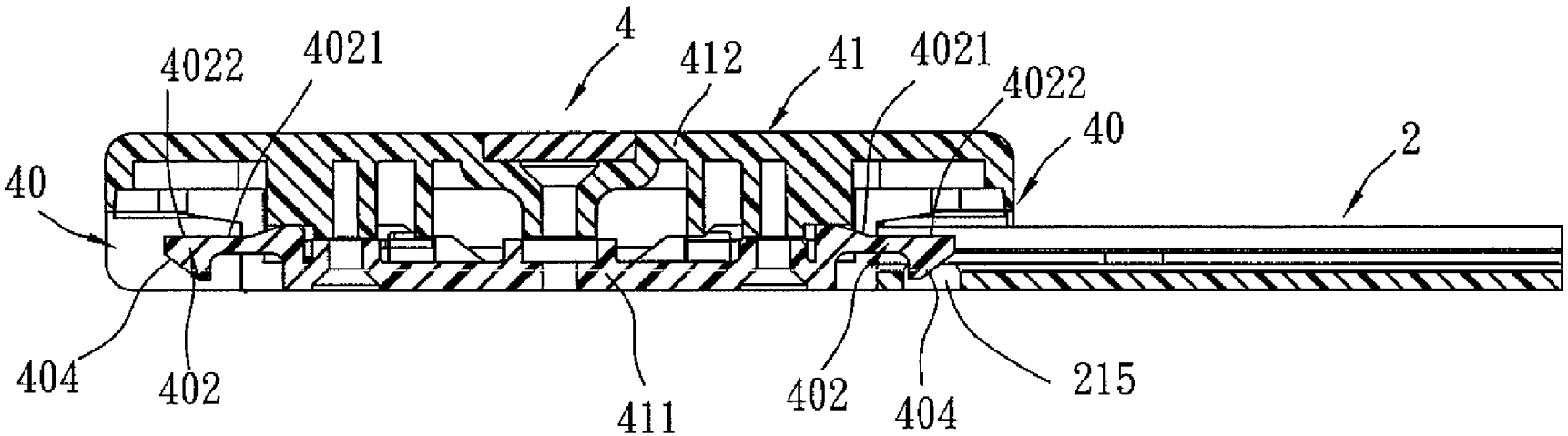
FIG. 5 is an assembled sectional view of the electrical connector and the electrical track of the first preferred embodiment.
Figure 6:
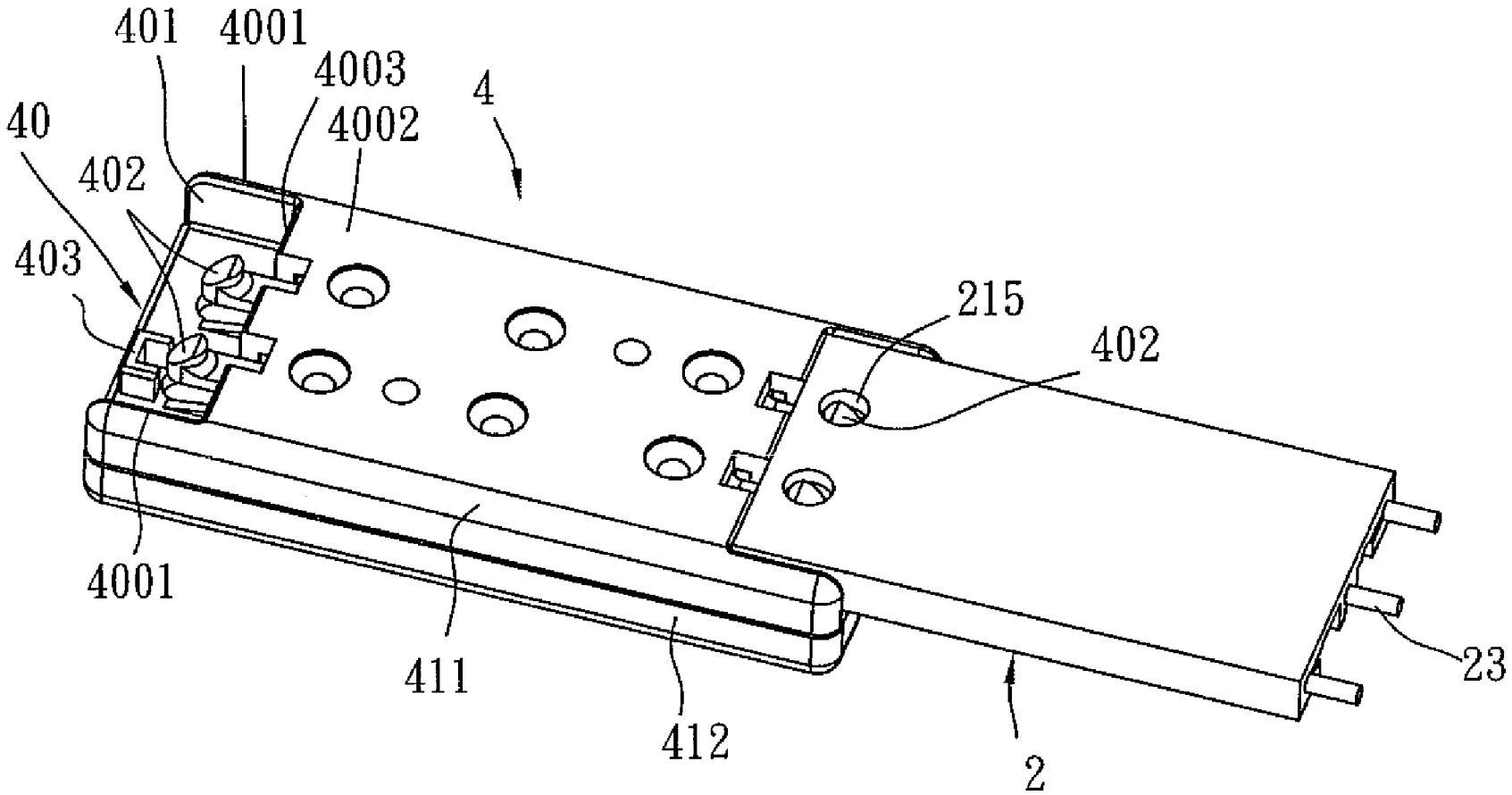
FIG. 6 is an assembled perspective view of the electrical track and the electrical connector of the first preferred embodiment.
Figure 7:
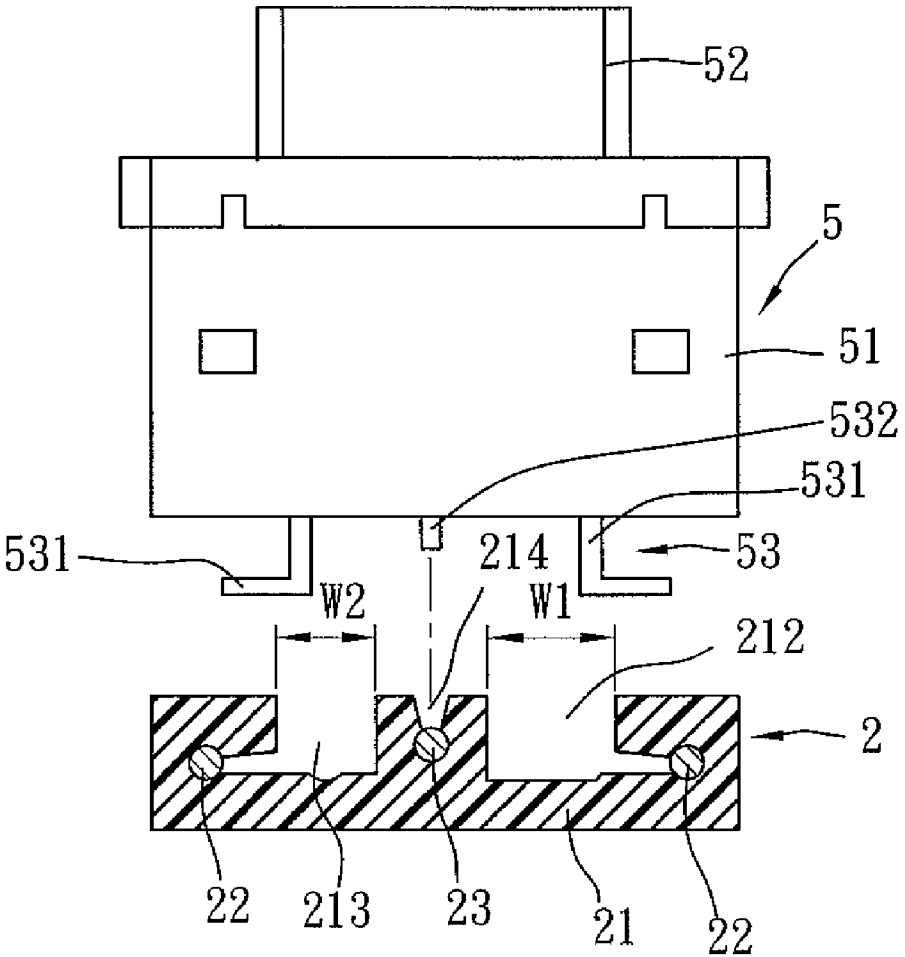
FIG. 7 is a partly sectional view illustrating how the electrical receptacle connects with the electrical track.

Before the present invention is described in greater detail, it should be noted that like elements are denoted by the same reference numerals throughout the disclosure.

Referring to FIGS. 3 to 7, the first preferred embodiment of an electric distributing system according to the present invention is shown to comprise a plurality of electrical tracks 2, a power supply plug 3, a plurality of electrical connectors 4, and a plurality of electrical receptacles 5.

Since the construction of each of the electrical tracks 2 is similar, only one electrical track 2 will be described herein. The electrical track 2 includes a track body 21 having two opposite ends 211, and first, second, and third grooves 212, 213, 214 that are parallel to each other and that extend between the ends 211 of the track body 21. Each end 211 of the track body 21 is provided with two retaining holes 215 respectively communicating with the first and second grooves 212, 213. Each of the first and second grooves 212, 213 has a wire-receiving section 2121, 2131, and a rib-receiving section 2122, 2132 in spatial communication with the wire-receiving section 2121, 2131. The third groove 214 is disposed between the first and second grooves 212, 213. An opening of the first groove 212 has a width (W1) larger than a width (W2) of an opening of the second groove 213. The electrical track 2 further includes two track wires 22 respectively disposed in the first and second grooves 212, 213, and a track ground wire 23 disposed in the third groove 214. Each track wire 22 has two opposite ends 221 projecting outwardly and respectively from the ends 211 of the track body 21. The track ground wire 23 also has two opposite ends 231 projecting outwardly and respectively from the ends 211 of the track body 21.

The power supply plug 3 is connected electrically to at least one of the electrical tracks 2, and is adapted to be connected electrically to a fixed electrical receptacle 10. Since electrical connection between the power supply plug 3 and the electrical track 2 is conventional, it is not detailed herein for the sake of brevity.

Since the construction of each of the electrical connectors 4 is similar, only one electrical connector 4 will be described herein. The electrical connector 4, in this embodiment, interconnects two electrical tracks 2, and includes a plastic housing 41, two conductive wire units 42, and a ground wire unit 43. The housing 41 has a base 411 for holding the conductive wire units 22 and the ground wire unit 23, and a cover 412 screwed fixedly to the base 411. The base 411 has two connecting end portions 40 at two ends thereof and connected respectively to the electrical tracks 2, and an aligning rib 403 provided on each of the connecting end portions 40. The aligning rib 403 has a width (W3) larger than the width (W2) of the opening of the second groove 213, but smaller than or equal to the width (W1) of the opening of the first groove 212.

Each of the connecting end portions 40 has a cutout portion 401 for extension of one end 211 of the track body 21 of one of the electrical tracks 2 thereinto. Each connecting end portion 40 has two parallel sidewall parts 4001, and a bottom wall part 4002 interconnecting the sidewall parts 4001. The sidewall parts 4001 extend beyond a distal edge 4003 of the bottom wall part 4002. The cutout portion 401 is defined by the distal edge 4003 of the bottom wall part 4002 and portions of the sidewall parts 4001. Each connecting end portion 40 further has two engaging members 402 configured as engaging arms 4021 projecting from the distal edge 4003 of the bottom wall part 4002 into the cutout portion 401. Each of the engaging arms 4021 has a hook end 4022 extending into the cutout portion 401 and engaged to a respective one of the retaining holes 215 at the end 211 of the track body 21. The hook end 4022 has an inclined guide face 404 to guide the electrical track 2 into the electrical connector 4.

The conductive wire units 42 are disposed in the housing 41. Each conductive wire unit 42 has two terminals 421 respectively disposed in the connecting end portions 40 and connected electrically and respectively to the track wires 22 of the electrical tracks 2, and a conductive wire 422 interconnecting the terminals 421.

The ground wire unit 43 is disposed in the housing 41, and has two ground terminals 431 respectively disposed in the connecting end portions 40 and connected electrically and respectively to the track ground wires 231 of the electrical tracks 2, and a ground wire 432 interconnecting the ground terminals 431.

Since the construction of each of the electrical receptacles 5 is similar, only one electrical receptacle 5 will be described herein. The electrical receptacle 5 is connected movably to one of the electrical tracks 2, and includes a rectangular main body 51, a socket 52 disposed on top of the main body 51, and a conductive plate unit 53 installed in the main body 51. The socket 52 has a rectangular neutral slot 521, a rectangular hot (or live) slot 522, and a semi-circular ground slot 523. The conductive plate unit 53 includes two conductive plates 531 respectively aligned with the neutral and hot slots 521, 522 and having bottom end portions projecting out of the main body 51, and a ground plate 532 aligned with the ground slot 523 and having a bottom end portion projecting out of the main body 51.

During assembly of the electric distributing system of the present invention, the electrical receptacle 5 is slidably connected to one of the electrical tracks 2 with the bottom end portions of the conductive plates 531 extending respectively into the first and second grooves 212, 213 of the electrical track 2 and the bottom end portion of the ground plate 532 extending into the third groove 214 of the electrical track 2. One end 211 of the electrical track 2 is then inserted into the corresponding cutout portion 401 of one of the electrical connectors 4. Through the presence of the aligning rib 403 in each connecting end portion 40 of the electrical connector 4, which is limited to extend solely into the first groove 212 of the corresponding electrical track 2, the conductive wire units 42 can be connected correctly to the track wires 22 of the electrical track 2. Further, through engagement of the engaging arms 4021 in each connecting end portion 40 of the electrical connector 4 with the retaining holes 215 in the corresponding end 211 of the track body 21 of the electrical track 2, the electrical connector 4 and the electrical track 2 can be interconnected stably, thereby further ensuring electrical connections among the components of the electric distributing system of the present invention.

Figure 8:
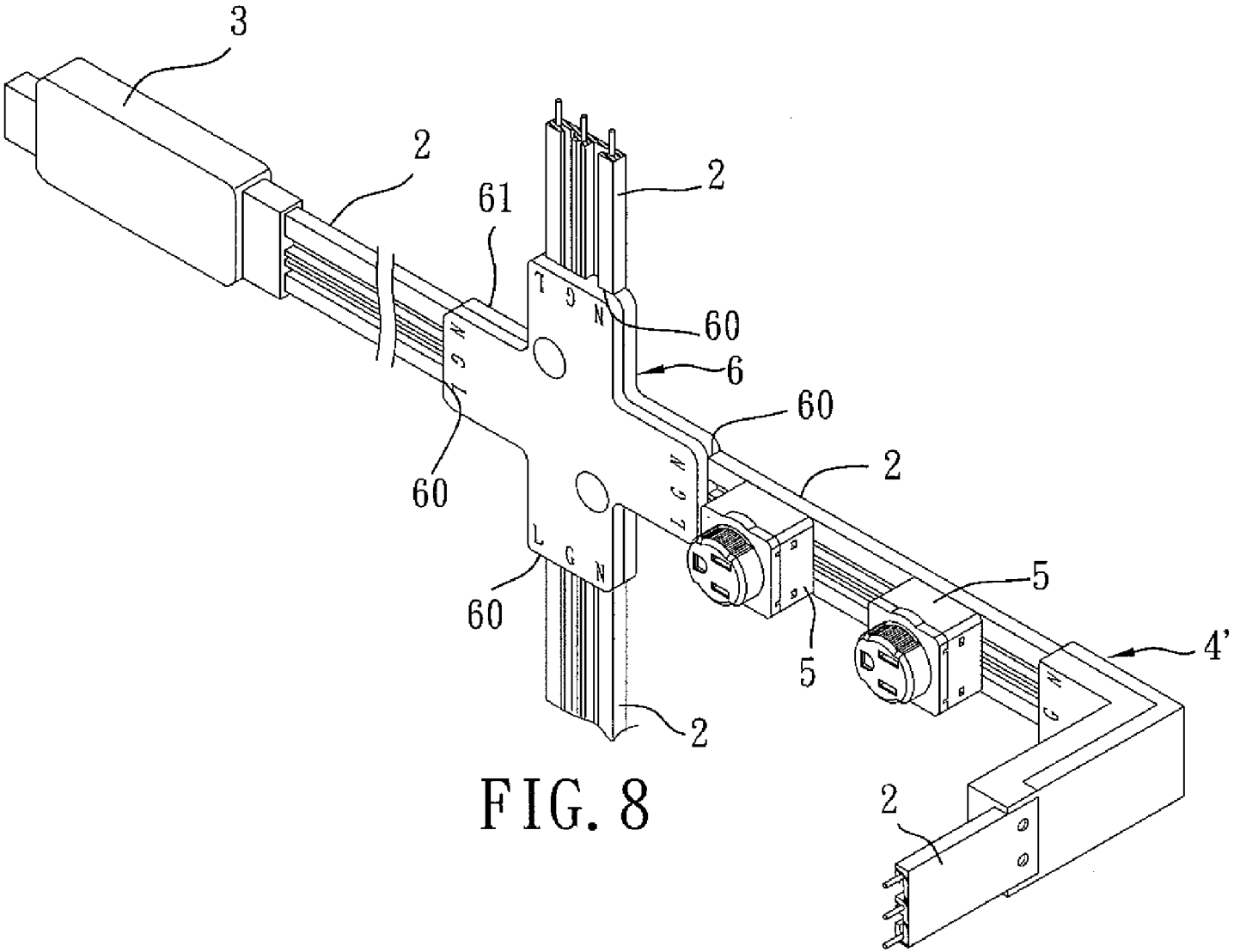
FIG. 8 is a fragmentary perspective view of the second preferred embodiment of an electric distributing system according to the present invention.
Figure 9:
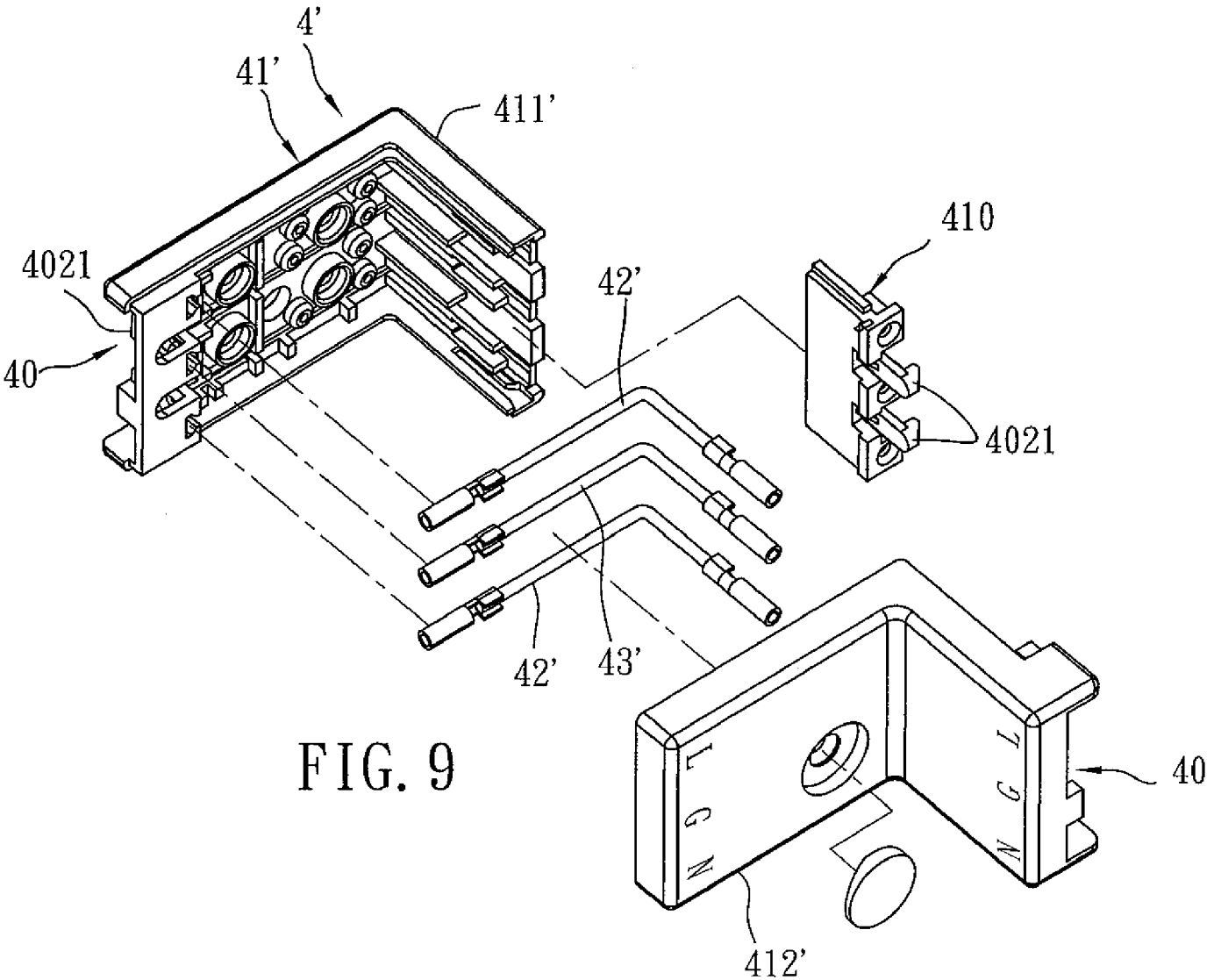
FIG. 9 is an exploded perspective view of an electrical connector of the second preferred embodiment.
Figure 10:
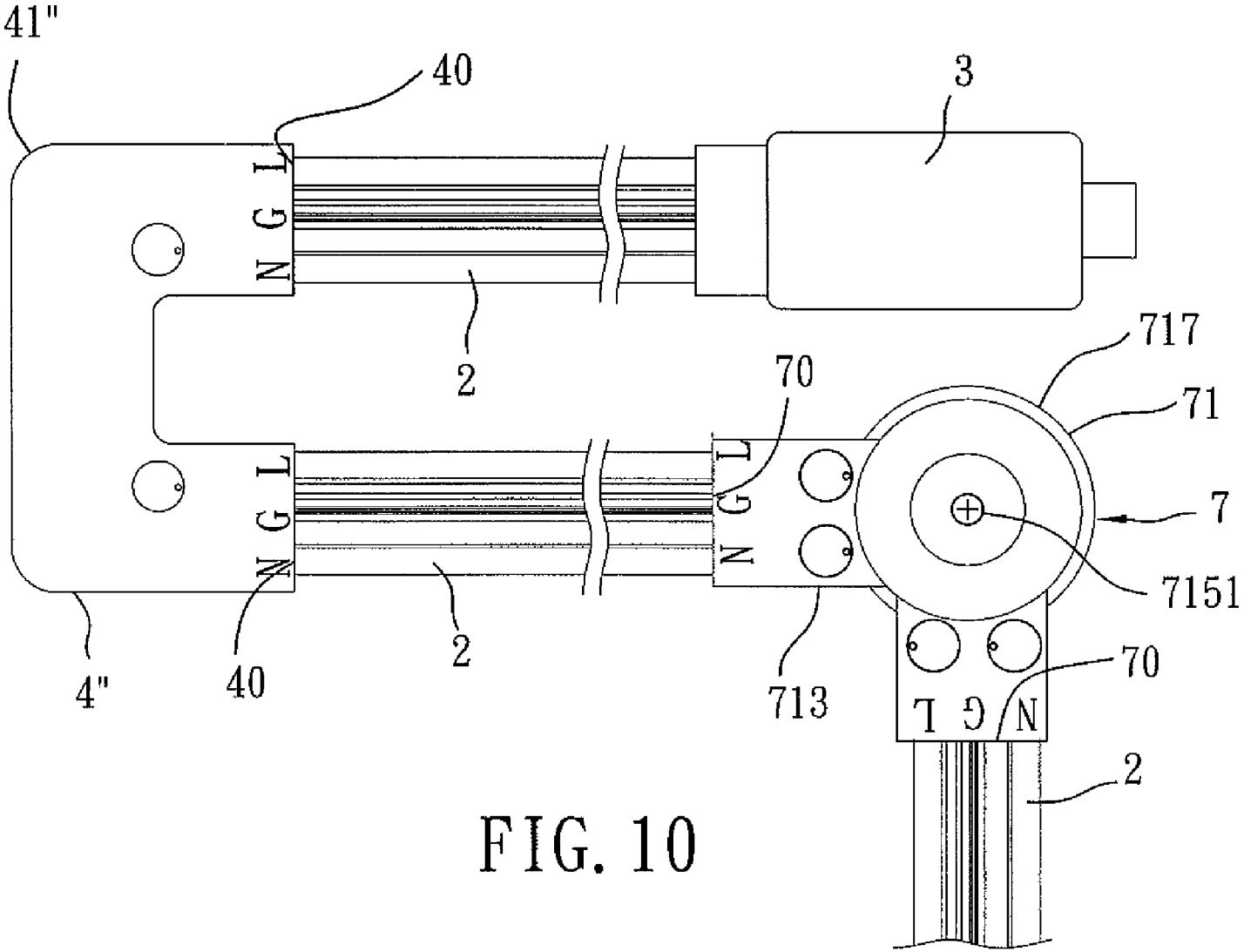
FIG. 10 is a fragmentary schematic view of the third preferred embodiment of an electric distributing system according to the present invention.
Figure 11:
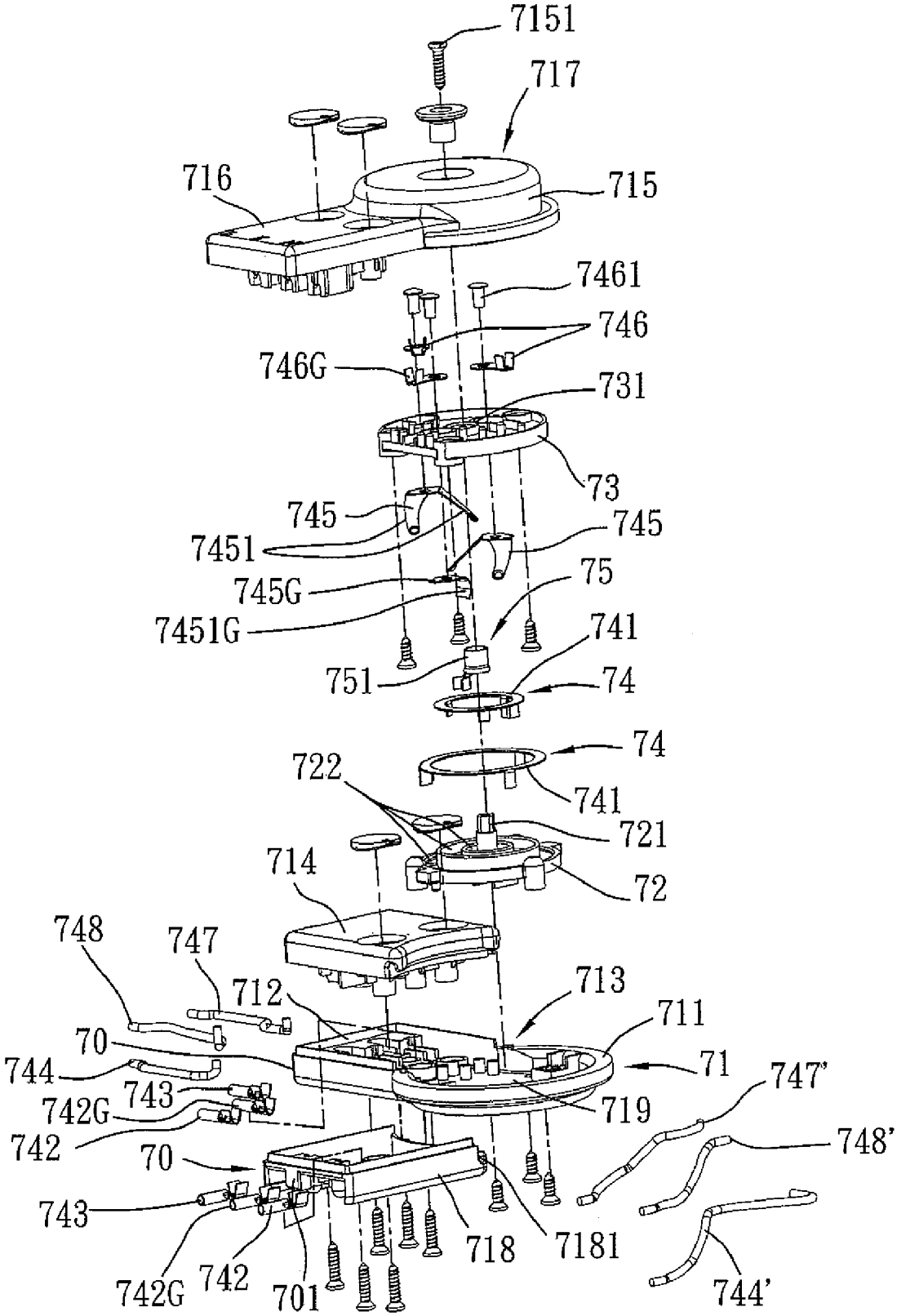
FIG. 11 is an exploded perspective view of an electrical connector of the third preferred embodiment.
Figure 12:
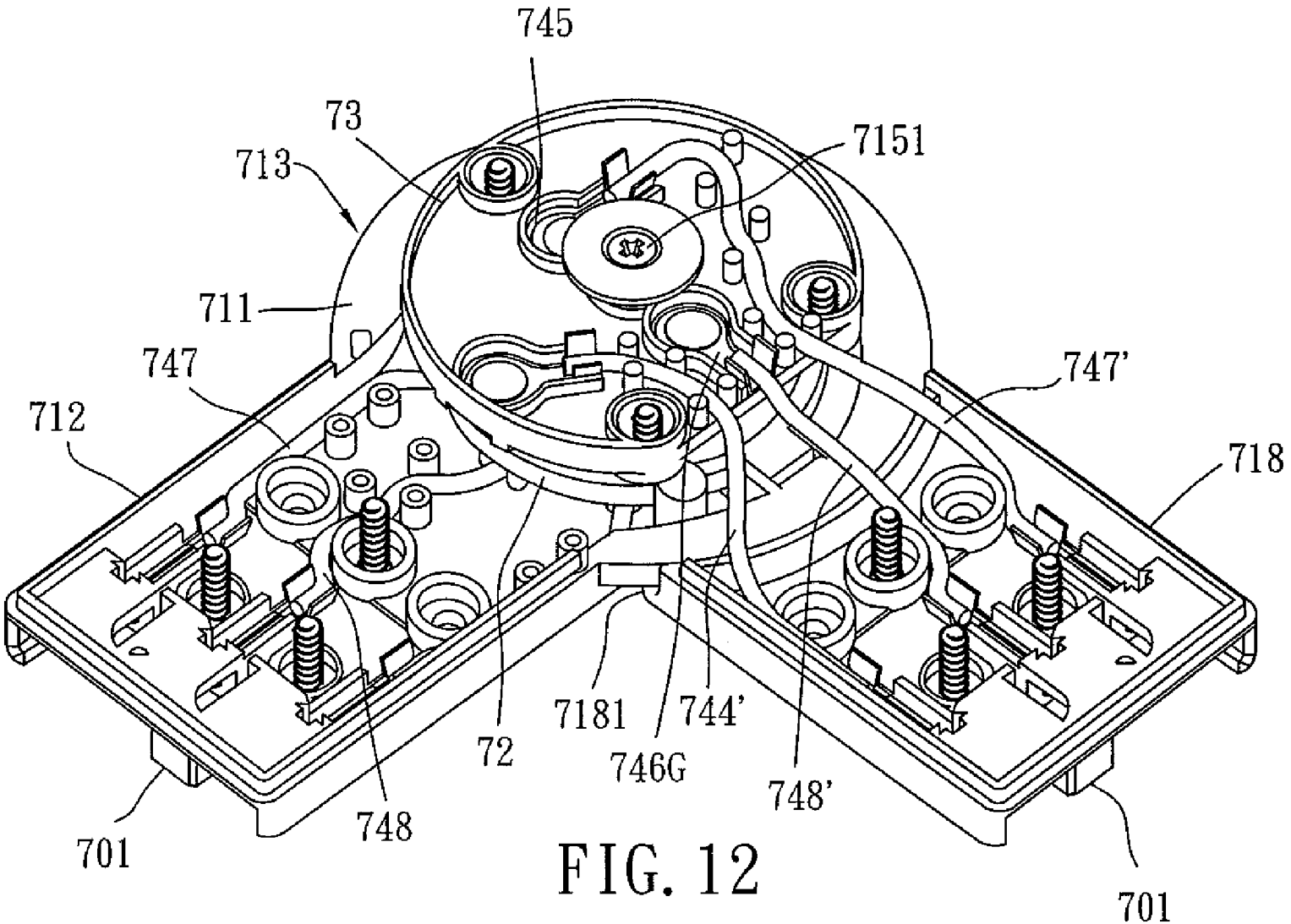
FIG. 12 is an assembled perspective view of the electrical connector of FIG. 11 with first and second covers removed.
Figure 13:
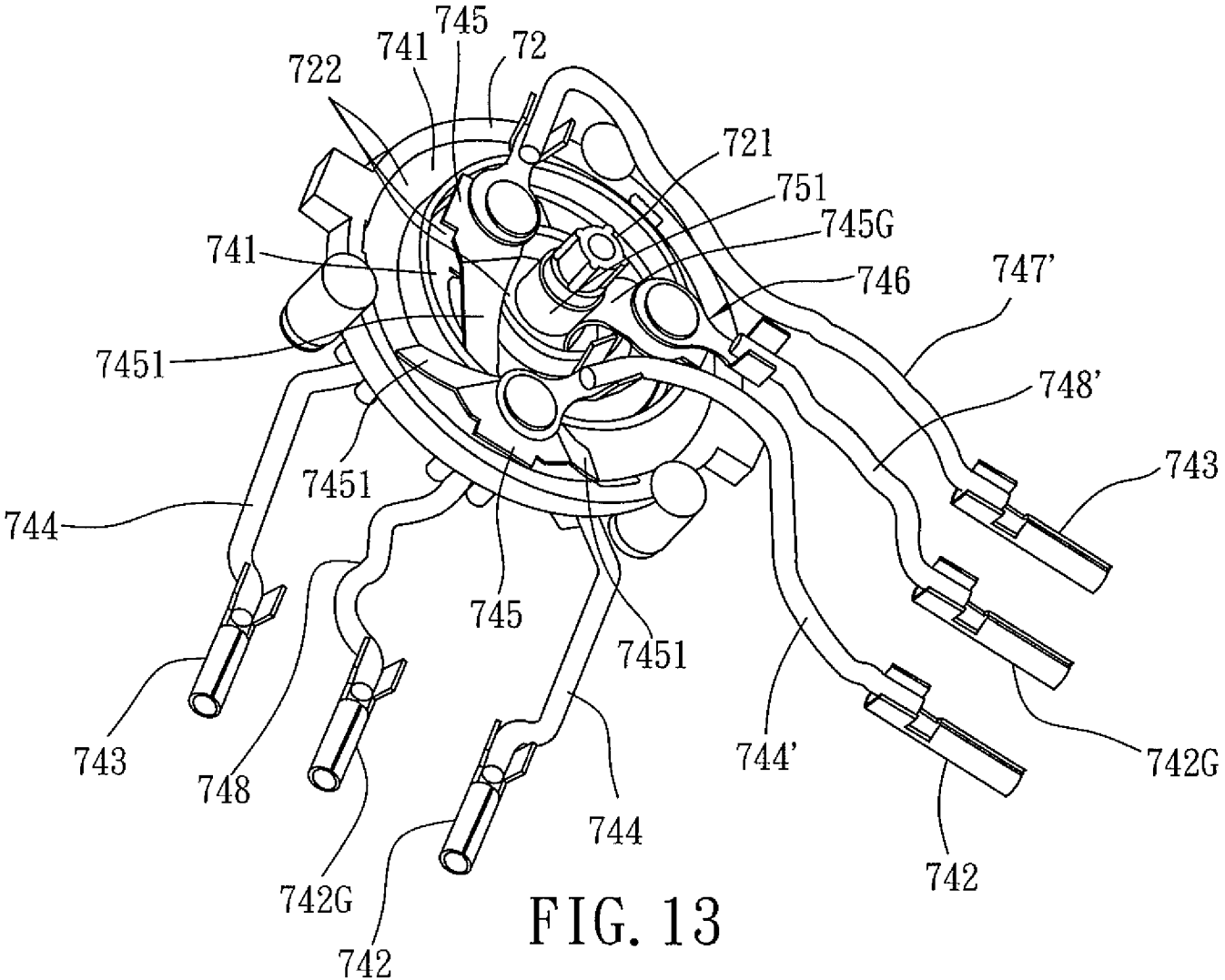
FIG. 13 is a view similar to FIG. 12, but with a movable disc, and first and second bases removed.

Referring to FIGS. 8 and 9, the second preferred embodiment of an electric distributing system according to the present invention is shown to comprise a power supply plug 3, a plurality of electrical tracks 2, two electrical connectors 6, 4', and a plurality of electrical receptacles 5. Since the construction of each of the power supply plug 3, the electrical track 2, and the electrical receptacle 5 is similar to that described in the first preferred embodiment, a detailed description of the same is dispensed herewith for the sake of brevity.

In this embodiment, the electrical connector 6 includes a cross-shaped housing 61 having four connecting end portions 60 connected respectively to four electrical tracks 2 and extending in four different track directions. The electrical connector 4' includes a housing 41', two conductive wire units 42' disposed in the housing 41', and a ground wire unit 43' disposed in the housing 41' parallel to and between the conductive wire units 42'. The housing 41' has two connecting end portions 40 connected respectively to two electrical tracks 2 and defined by an L-shaped base 411' and an L-shaped cover 412' screwed fixedly to the base 411'. The engaging arms 4021 on each connecting end portion 40 are provided on a connecting plate 410 which is fixed to the base 41'.

Referring to FIGS. 10 to 13, the third preferred embodiment of an electric distributing system according to the present invention is shown to comprise a power supply plug 3, a plurality of electrical tracks 2, two electrical connectors 4", 7, and a plurality of electrical receptacles (not shown) mounted movably on the electrical tracks 2. Since the construction of each of the power supply plug 3, the electrical tracks 2, and the electrical receptacles is similar to that described in the first preferred embodiment, a detailed description of the same is dispensed herewith.

The electrical connector 4" is similar to that described in the first preferred embodiment. However, in this embodiment, the electrical connector 4" has a U-shaped housing 41" with two connecting end portions 40 connected respectively to two electrical tracks 2. The connecting end portions 40 are spaced apart from each other, and extend substantially parallel to each other along a track direction.

The electrical connector 7 includes a housing 71, a fixed disc 72, a movable disc 73, two conductive wire units 74, and a ground wire unit 75. The housing 71 has two connecting end portions 70 angled to each other and rotatable relative to each other. The housing 71 includes a first base 713, a first cover 717, a second cover 714, and a second base 718. The first base 713 has a circular first pivot portion 711, and a first radial extension 712 extending radially from the first pivot portion 711. The first cover 717 has a circular second pivot portion 715, and a second radial extension 716 extending radially from the second pivot portion 715. The second cover 714 is screwed fixedly to the top of the first radial extension 712 so as to cover the same. The second base 718 is screwed fixedly to the bottom of the second radial extension 716 so as to be covered by the same, and has a guide projection 7181 in sliding contact with a bottom surface of the first pivot portion 711. The second pivot portion 715 is pivoted to the first pivot portion 711 in such a manner that the second radial extension 716 is spaced apart angularly from the first radial extension 712. One of the connecting end portions 70 is defined by the first radial extension 712 and the second cover 714. The other one of the connecting end portions 70 is defined by the second base 718 and the second radial extension 716. Each connecting end portion 70 has an aligning rib 701.

The fixed disc 72 and the movable disc 73 are received in a space 719 between the first and second pivot portions 711, 715. The fixed disc 72 has a pivot shaft 721 projecting from the center thereof and extending through a central hole 731 of the movable disc 73. The pivot shaft 721 also extends through the second pivot portion 715, and is fastened to the second pivot portion 715 by means of a fastener 7151. The fixed disc 72 has three concentric annular grooves 722 around the pivot shaft 721. The fixed disc 72 is screwed fixedly to the first pivot portion 711, whereas the movable disc 73 is screwed fixedly to the second pivot portion 715. Hence, the movable disc 73 is connected pivotally to the fixed disc 72 about the pivot shaft 721.

Each of the conductive wire units 74 has two terminals 742, 743 respectively disposed in the connecting end portions 70, a fixed wire 744, 747 and a movable wire 744 ', 747' respectively connected to the terminals 742, 743, a fixed contact member 741 and a movable contact member 745 respectively connected to the fixed and movable wires 744, 747, 744', 747', and an intermediate terminal 746 disposed on top of the movable disc 73. Each of the terminals 742, 743 is connected to one of the track wires 22 of one of the electrical tracks 2. The fixed contact member 741 is a conductive ring supported by the fixed disc 72, and is disposed around the pivot shaft 721. The movable contact member 745 is fixed to a bottom side of the movable disc 73 by means of a conductive stud 7461 which extends through the movable disc 73 and which is connected to the intermediate terminal 746. As such, the intermediate terminal 746 and the movable contact member 745 are connected electrically to each other. The movable contact member 745 has two downwardly extending resilient contact legs 7451 in sliding contact with the fixed contact member 741.

The ground wire unit 75 is disposed in the housing 71, and has two ground terminals (742G) respectively disposed in the connecting end portions 70, a fixed ground wire 748 and a movable ground wire 748' respectively connected to the ground terminals (742G) a fixed ground contact member 751 and a movable ground contact member (745G) respectively connected to the fixed and movable ground wires 748, 748', and an intermediate ground terminal (746G) disposed on top of the movable disc 73. Each of the ground terminals (742G) is connected to the track ground wire 23 of one of the electrical tracks 2. The fixed ground contact member 751 is a ground ring disposed around the pivot shaft 721, and is supported by the fixed disc 72. The movable ground contact member (745G) is in sliding contact with the fixed ground contact member 751, and is fixed to the bottom side of the movable disc 73 by means of a conductive stud 7461 which extends through the movable disc 73 and which is connected to the intermediate ground terminal (746G). As such, the intermediate ground terminal (746G) and the movable ground contact member (745G) are connected electrically to each other. The movable ground contact member (745G) has a downwardly extending resilient contact leg (7451G) in sliding contact with the fixed ground contact member 751. The fixed contact members 741 and the fixed ground contact member 751 are respectively received in the annular grooves 722 of the fixed disc 72.

Therefore, through the presence of the fixed and movable discs 72, 73 in the housing 71, the two connecting end portions 70 of the electrical connector 7 can provide different angular positions of the electrical tracks 2 to satisfy different installation requirements.

Figure 14:
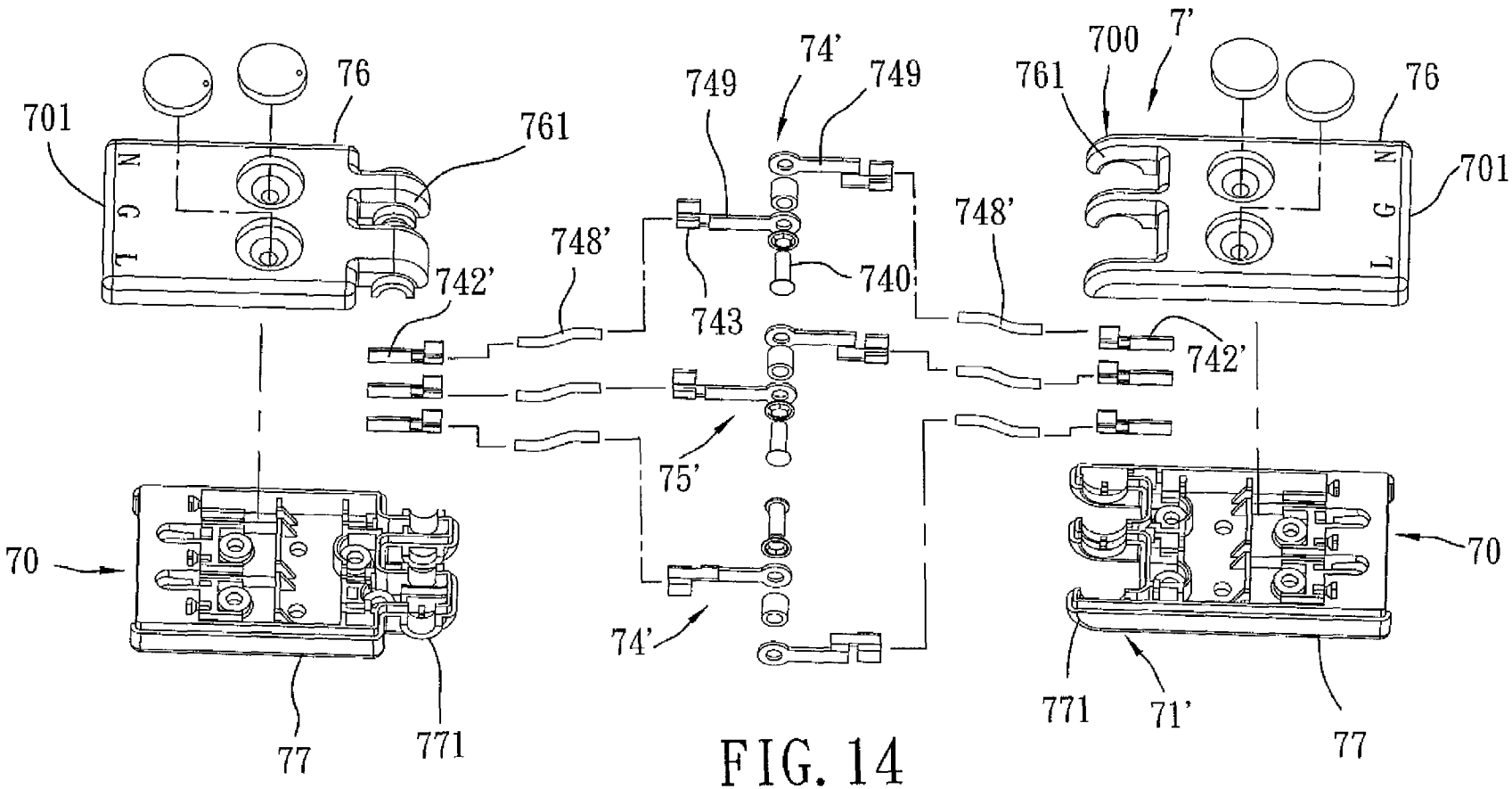
FIG. 14 is an exploded perspective view of an electrical connector of an electric distributing system according to the fourth preferred embodiment of the present invention.

Referring to FIG. 14, the fourth preferred embodiment of an electric distributing system according to the present invention is shown to be similar to the third preferred embodiment. In the third preferred embodiment, the connecting end portions 70 of the electrical connector 7 are rotatable relative to each other. In this embodiment, the two connecting end portions 70 of the electrical connector 7' are pivotable relative to each other. Hence, the electrical connector 7' includes a housing 71' having two housing parts 701, a pivot connection 700 interconnecting the housing parts 701, two conductive wire units 74', and a ground conductive wire unit 75'. Each of the housing parts 701 has a base 77, and a cover 76 screwed fixedly to the base 77. The base 77 of each housing part 701 has the respective connecting end portions 70, and has a base pivot part 771. The cover 76 has a cover pivot part 761. The base pivot parts 771 of the bases 77 and the cover pivot parts 761 of the covers 76 of the two housing parts 701 cooperatively form the pivot connection 700.

The conductive wire units 74' are disposed in the housing 71' Each of the conductor wire units 74' has two terminals 742' respectively disposed in the connecting end portions 70, two conductive wires 748' respectively connected to the terminals 742', two conductive clamps 749 respectively connected to the conductive wires 748', and a spindle 740 interconnecting pivotally the conductive clamps 749. Each of the terminals 742' is connected electrically to one of the track wires 221 of one of the electrical tracks 2. The spindle 740 is disposed within the pivot connection.

Since the construction of the ground wire unit 75' is similar to that of each conductive wire unit 74', a detailed description of the same will be dispensed herewith for the sake of brevity.

Figure 15:
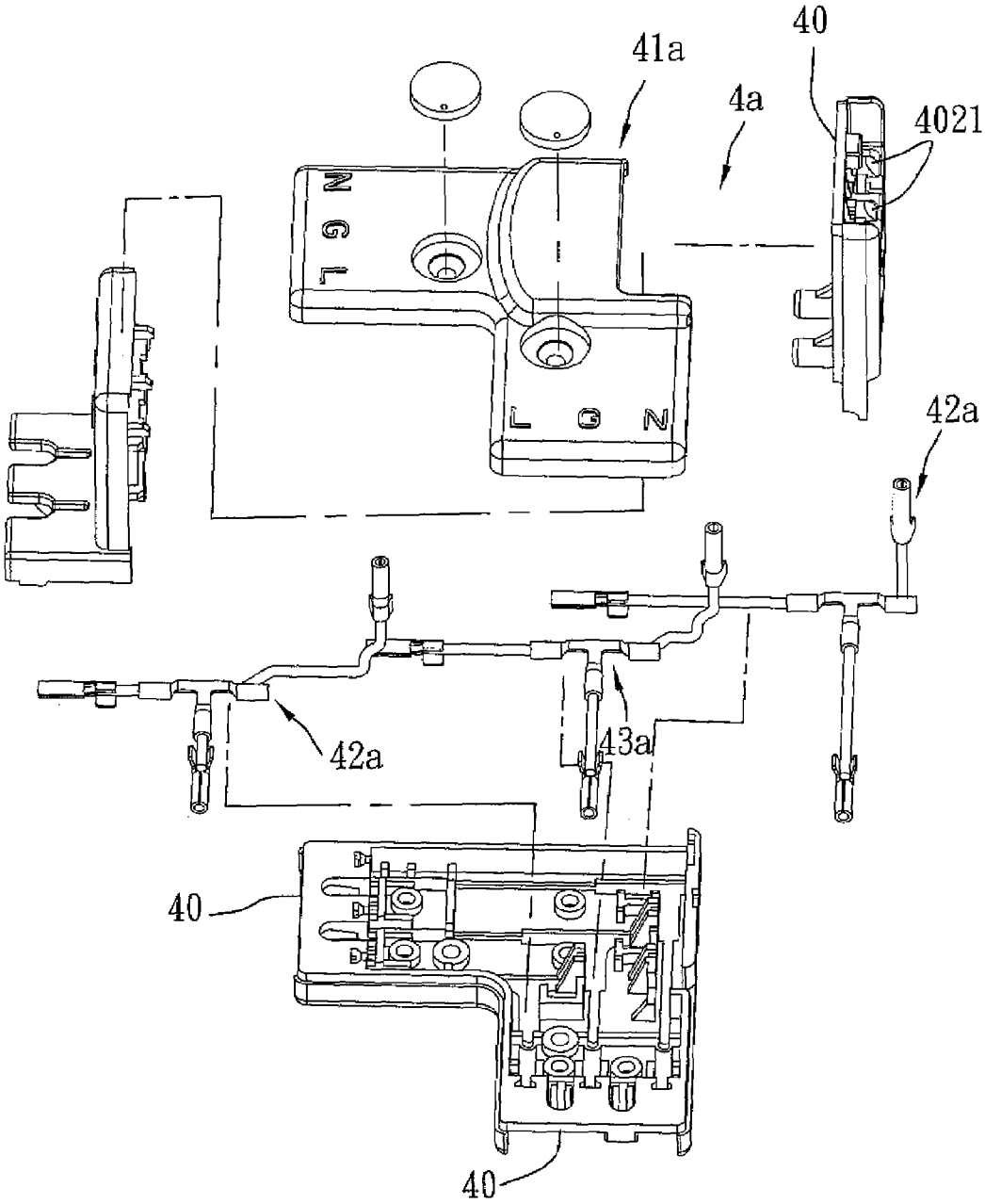
FIG. 15 is an exploded perspective view of an electrical connector of an electric distributing system according to the fifth preferred embodiment of the present invention.

FIG. 15 illustrates an electrical connector (4*a*) of an electric distributing system according to the fifth preferred embodiment of the present invention. The electrical connector (4*a*) is shown to be similar to the electrical connector 4 of the first preferred embodiment. However, in this embodiment, the electrical connector (4*a*) includes a housing (41*a*) having three connecting end portions 40 extending in three different track directions and connected respectively to three electrical tracks 2 (see FIG. 3). Two of the connecting end portions 40 are located on the same plane. A third one of the connecting end portions 40 is located on a plane perpendicular to that of the other two connecting end portions 40. The engaging arms 4021 are provided on each connecting end portion 40 of the housing (41*a*).

Figure 16:
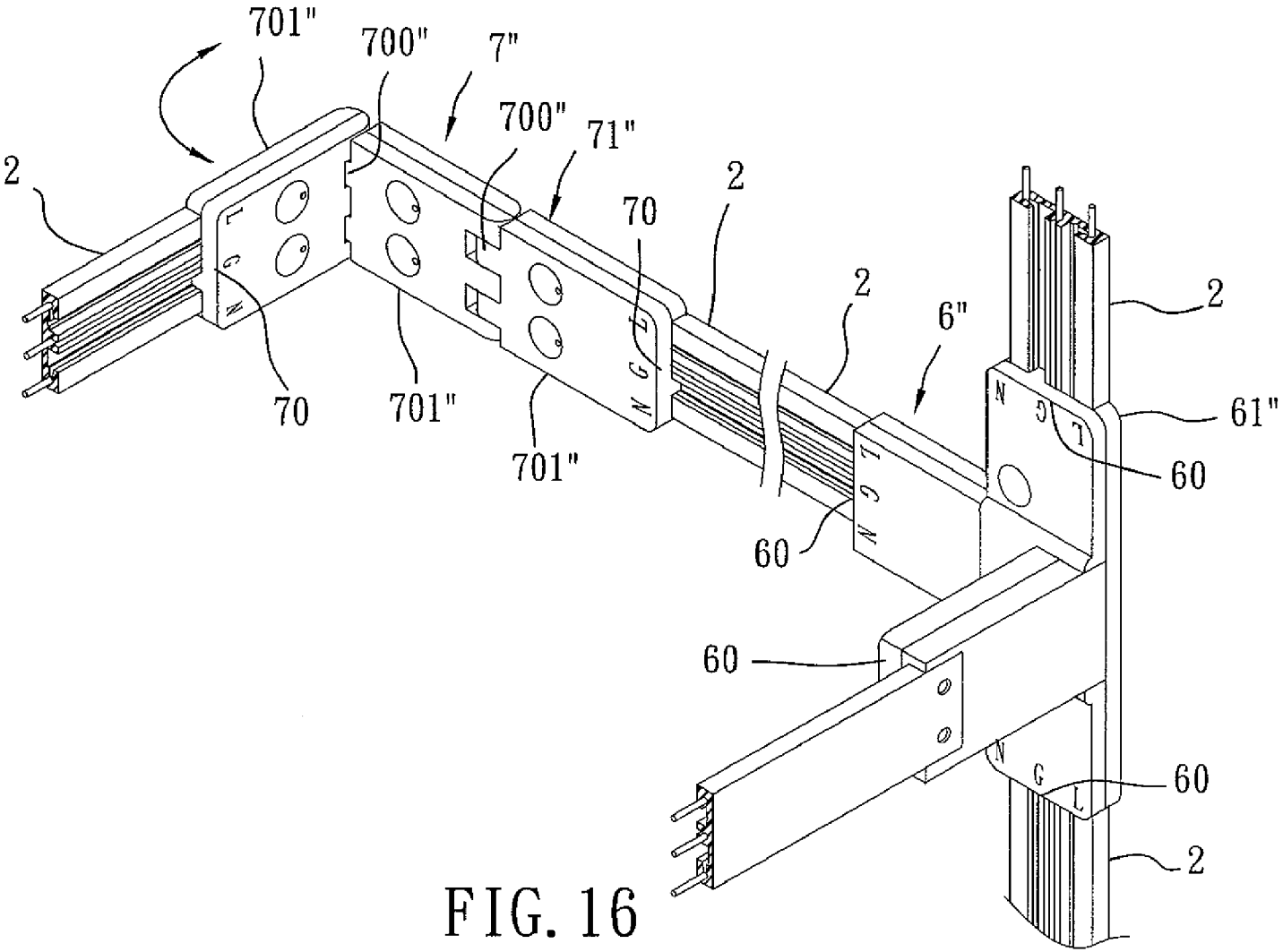
FIG. 16 is a perspective view of the sixth preferred embodiment of an electric distributing system according to the present invention.

Referring to FIG. 16, the sixth preferred embodiment of an electric distributing system according to the present invention is shown to comprise a plurality of electrical tracks 2, and two electrical connectors 6", 7". The electrical connector 6" includes a housing 61" having four connecting end portions 60 extending in four different track directions and connected respectively to four electrical tracks 2. Three of the connecting end portions 60 are located on the same plane. A fourth one of the connecting end portions 60 is located on a plane perpendicular to that of the other three connecting end portions 60.

The electrical connector 7" is similar to the electrical connector 7' of the fourth preferred embodiment. However, in this embodiment, the electrical connector 7" includes a housing 71" having three housing parts 701", and two pivot connections 700" each interconnecting pivotally two adjacent ones of the housing parts 701". The housing 71" further has two connecting end portions 70 connected respectively to two electrical tracks 2.

Figure 17:
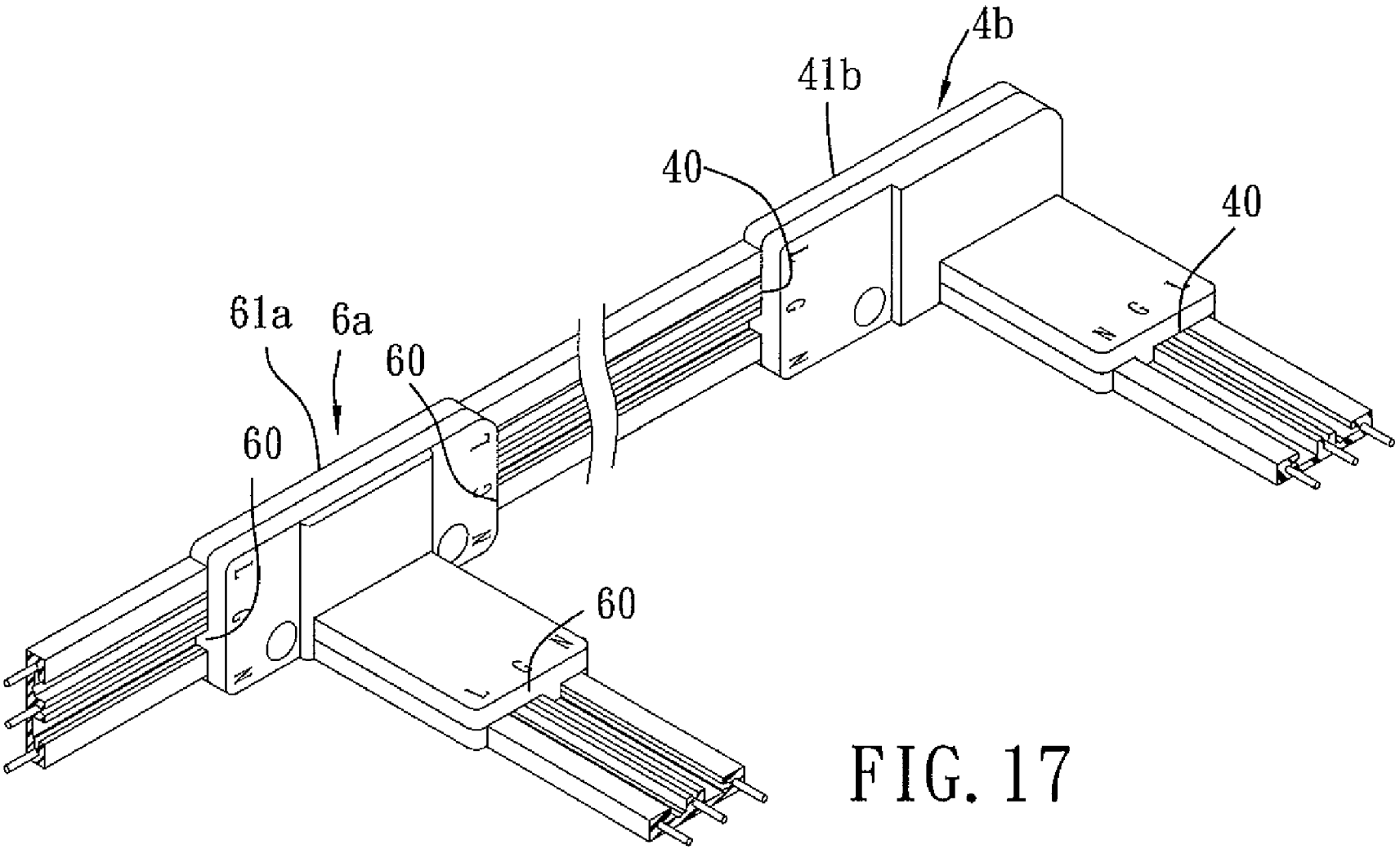
FIG. 17 is a perspective view of the seventh preferred embodiment of an electric distributing system according to the present invention.

Referring to FIG. 17, the seventh preferred embodiment of an electric distributing system according to the present invention is shown to be similar to the first preferred embodiment. However, in this embodiment, the electric distributing system includes a plurality of electrical tracks 2 and two electrical connectors (4*b*, 6*a*). The electrical connector (4*b*) includes a housing (41*b*) having two connecting end portions 40 connected respectively to two electrical tracks 2. The connecting end portions 40 extend in two different track directions, and are located on two different planes. The electrical connector (6*a*) has a housing (61*a*) having three connecting end portions 60 connected respectively to three electrical tracks 2. Two of the connecting end portions 60 are located on the same plane. A third one of the connecting end portions 60 is located on a plane perpendicular to that of the other two connecting end portions 60.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electric distributing system comprising:

at least two electrical tracks, each of which includes a track body having two opposite ends, at least two grooves parallel to each other, adjacent to which are corresponding wire receiving sections; wherein at least two track wires are respectively disposed, at least one of said opposite ends being provided with a retaining hole penetrating through at least one groove; and an electrical connector including a housing having at least two connecting end portions that interconnect said electrical tracks, and at least two conductive wire units disposed in said housing and connected electrically and respectively to said track wires, at least one of said connecting end portions having an engaging member;

wherein each of said connecting end portions further has a cutout portion, one of said two opposite ends of said track body of one of said electrical tracks extending into said cutout portion, said engaging member being configured as an engaging arm having a hook end extending into said cutout portion: and wherein said housing has a base holding said conductive wire units, and a cover covering said base, said base having said connecting end portions at two ends of said base, each of said connecting end portions having two parallel sidewall parts, and a bottom wall part interconnecting said sidewall parts, said sidewall parts extending beyond a distal edge of said bottom wall part, said cutout portion being defined by said distal edge of said bottom wall part and portions of said sidewall parts, said engaging arm projecting from said distal edge into said cutout portion to engage said retaining hole.

2. The electric distributing system of claim 1, wherein said hook end has an inclined guide face.

3. The electric distributing system of claim 1, wherein said housing has two housing parts and a pivot connection interconnecting said housing parts, each of said housing parts having a base and a cover covering said base, said base of each of said housing parts having one of said connecting end portions.

4. The electric distributing system of claim 3, wherein each of said conductive wire units has two terminals respectively disposed in said connecting end portions, two conductive wires respectively connected to said terminals, two conductive clamps respectively connected to said conductive wires, and a spindle interconnecting pivotally said conductive clamps, each of said terminals being connected electrically to one of said track wires of one of said electrical tracks, said spindle being disposed within said pivot connection.

5. An electric distributing system comprising:

at least two electrical tracks, each of which includes a track body, and at least two track wires disposed in said track body, said track body having two opposite ends, at least one of said opposite ends being provided with a retaining hole; and an electrical connector including a housing having at least two connecting end portions that interconnect said electrical tracks, and at least two conductive wire units disposed in said housing and connected electrically and respectively to said track wires, at least one of said connecting end portions having an engaging member projecting therefrom and engaged to said retaining hole;

wherein said connecting end portions of said housing are angled to each other and are rotatable relative to each other, each of said conductive wire units having two terminals respectively disposed in said connecting end portions, each of said terminals being connected electrically to one of said track wires of one of said electrical tracks; and wherein each of said conductive wire units further has a fixed wire and movable wire respectively connected to said two terminals, and a fixed contact member and a movable contact member respectively connected to said fixed and movable wires, said movable contact member being in sliding contact with said fixed contact member.

6. The electric distributing system of claim 5, wherein said electrical connector further includes a fixed disc and a movable disc disposed within said housing, said movable disc being connected pivotally to said fixed disc about a pivot shaft, said fixed contact member being a conductive ring supported by a said fixed disc and disposed around said pivot shaft, said movable contact member being fixed to said movable disc.

7. The electric distributing system of claim 6, wherein said housing includes a first base that has a first pivot portion and a first radial extension extending radially from said first pivot portion, a first cover that has a second pivot portion and a second radial extension extending radially from said second pivot portion, a second cover covering said first radial extension, and a second based connected to and covered by said second radial extension, said second pivot portion being pivoted to said first pivot portion in such a manner that said second radial extension is spaced apart angularly from said first radial extension, said fixed disc and said movable disc being received in a space between said first and second pivot portions.

8. The electric distributing system of claim 7, wherein each of said electrical tracks further has a track ground wire, said electrical connector further including a ground wire unit disposed in said housing and having two ground terminals connected electrically and respectively to said track ground wires of said electrical tracks, a fixed ground wire and a movable ground wire respectively connected to said ground terminals, and a fixed ground contact member and a movable ground contact member respectively connected to said fixed and movable ground wires, said movable ground contact member being in sliding contact with said fixed ground contact member and fixed to said movable disc, said fixed ground contact member being a ground ring disposed around said pivot shaft, said fixed disc having three concentric annular grooves around said pivot shaft and respectively receiving said conductive rings of said two conductive wire units and said ground ring.

* * * * *